US005596919A

United States Patent [19]

Kusch et al.

[11] Patent Number: 5,596,919

[45] Date of Patent: Jan. 28, 1997

[54] DEVICE FOR HOLDING OR RECEIVING INDEXABLE PERFORATING TOOLS

[75] Inventors: Hans-Jürgen Kusch, Neckargemünd; Bernd Ruf, Weiterstadt; Rudi Stellberger, Kronau, all of Germany

[73] Assignee: Heidelberger Druckmaschinen AG, Heidelberg, Germany

[21] Appl. No.: 293,677

[22] Filed: Aug. 19, 1994

[30] Foreign Application Priority Data

Aug. 19, 1993 [DE] Germany ..... 43 27 863.9

[51] Int. Cl.[6] ..... B26D 1/22

[52] U.S. Cl. ..... 83/507; 83/660; 83/678.510

[58] Field of Search ..... 83/698.51, 344, 83/503, 504, 507, 508.2, 660, 698.61

[56] References Cited

U.S. PATENT DOCUMENTS

| | | | |
|---|---|---|---|
| 1,661,619 | 3/1928 | Paddack | 83/504 |
| 2,048,684 | 7/1936 | Carr | 83/503 |
| 3,706,250 | 12/1972 | Herd | 83/344 |
| 3,832,925 | 9/1974 | Brandt et al. . | |
| 3,855,890 | 12/1974 | Lynch et al. | 83/344 |
| 3,956,957 | 3/1976 | Corse | 83/503 |
| 4,226,150 | 10/1980 | Reed | 83/344 |

FOREIGN PATENT DOCUMENTS

| | | |
|---|---|---|
| 0040183 | 11/1981 | European Pat. Off. . |
| 0058629 | 8/1982 | European Pat. Off. . |
| 0444612 | 9/1991 | European Pat. Off. . |
| 1019321 | 11/1957 | Germany . |
| 1561176 | 3/1970 | Germany . |
| 2235511 | 2/1975 | Germany . |
| 3510276 | 5/1986 | Germany . |
| 2912458 | 1/1988 | Germany . |
| 4021470 | 2/1991 | Germany . |
| 4230938 | 3/1994 | Germany . |

*Primary Examiner*—Kenneth E. Peterson
*Attorney, Agent, or Firm*—Herbert L. Lerner; Laurence A. Greenberg

[57] ABSTRACT

Device for holding perforating tools opposite a sheet-carrying cylinder of a rotary printing press includes a bearing and indexing shaft, a carrier body axially displaceably supported by the shaft, the carrier body being formed with a bore extending therethrough axially parallel to the shaft, the carrier body being provided with a clamping device for clamping the carrier body relative to the shaft and with an actuating device for, respectively, effecting a mutual clamping of the shaft and the carrier body and for releasing a mutual clamping of the shaft and the carrier body, the actuating device including rotatably supported rings carried by the carrier body around the shaft, the rings including an eccentric ring provided with a perforating tool.

8 Claims, 2 Drawing Sheets

DEVICE FOR HOLDING OR RECEIVING INDEXABLE PERFORATING TOOLS

Figure 1:
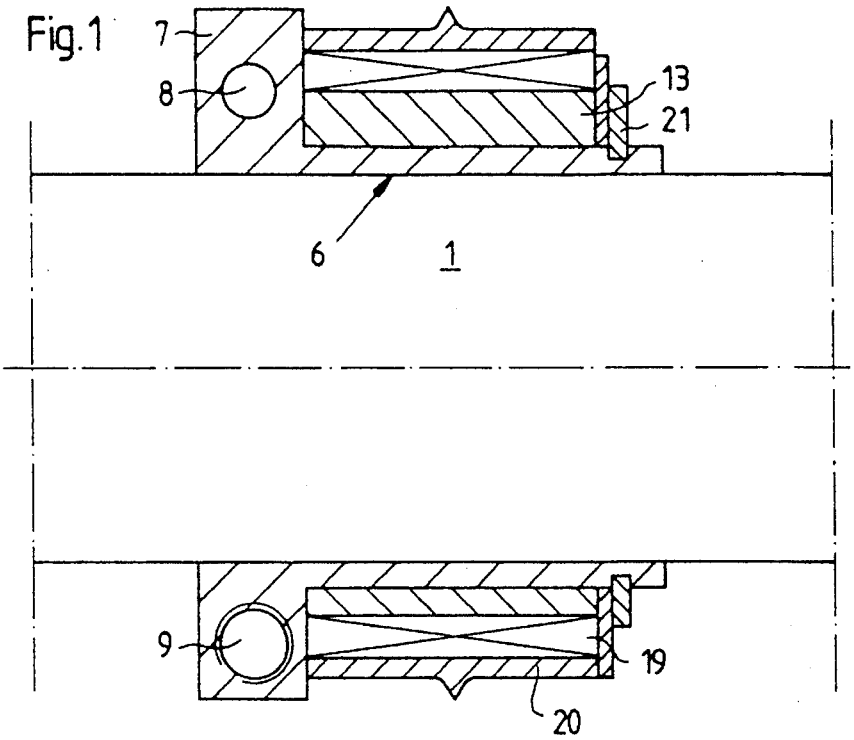

The invention relates to a device for holding or receiving indexable perforating tools opposite a sheet-carrying cylinder of a rotary printing press, including a bearing and indexing shaft, a carrier body axially displaceably supported by the shaft, the carrier body being formed with a bore extending therethrough axially parallel to the shaft, the carrier body being provided with clamping means for clamping the carrier body relative to said shaft and with actuating means for, respectively, effecting a mutual clamping of the shaft and said carrier body and for releasing a mutual clamping of the shaft and the carrier body, the actuating means being formed of rotatably supported rings.

From Published, Non-Examined German Patent Application DE-OS 1 561 176, a perforating device has become known wherein a die or matrix holder and a mating gear or wheel are accommodated in displaceable housings. Displacement of the housings transversely to a web of material is realized via displacement spindles operatable by handwheels. With this conventional device, webs of material particularly are perforatable; such a device is unsuitable, however, for processing sheets, because too much space is taken up thereby.

The published German Patent Document DE 22 35 511 C3 discloses an arrangement for stamping rows of perforations in endless webs of paper in a rotary printing press. Upper tools mounted on a stationary shaft perforate a web of paper moving past them, and retractable and extensible pins of these upper tools are remachinable by means of a grinder device. The individual upper tools are fixable in a working position thereof on the stationary shaft by means of screws.

The published German Patent Document DE 29 12 458 C2 has disclosed a rotary stamp with an opposing or counter roller braced against a knife roller. The knife roller and the counter roller are supported in bearings disposed opposite one another, with a body of adjustable width located therebetween. With the aid of this construction, the positioning or engaging forces and, accordingly, the wear of the cutting tools can be influenced or varied.

The published German Patent Document DE 40 21 470 A1 discloses a clamping device for a carrier body of a cutting roller opposite to a shaft in a cutting device for longitudinally cutting webs of material. In this device, clamping means, which have one end thereof travelling on a curved path of an adjusting ring and the other end thereof formed on dovetail-like clamping surfaces which taper in a wedge-like manner, are guided in clamping body halves on the shaft. This construction is labor-intensive and hence expensive in terms of production technology. It imposes great demands in terms of meeting tolerance ranges during production and requires high dimensional or fitting accuracy of the components with respect to one another.

Starting from the aforediscussed prior art, it is an object of the invention to provide a device for receiving indexable perforating tools which, while using relatively few components, permits perforating tools to be disposed opposite a sheet-carrying cylinder in a space-saving manner.

With the foregoing and other objects in view, there is provided, in accordance with the invention, a device for holding perforating tools opposite a sheet-carrying cylinder of a rotary printing press, comprising a bearing and indexing shaft, a carrier body axially displaceably supported by the shaft, the carrier body being formed with a bore extending therethrough axially parallel to the shaft, the carrier body being provided with clamping means for clamping the carrier body relative to the shaft and with actuating means for, respectively, effecting a mutual clamping of the shaft and the carrier body and for releasing a mutual clamping of the shaft and the carrier body, the actuating means comprising rotatably supported rings carried by the carrier body around the shaft, the rings including an eccentric ring provided with a perforating tool.

In accordance with another feature of the invention, the actuating means include a roller bearing carrying a perforating ring supported on the eccentric ring.

In accordance with a further feature of the invention, the actuating means include a roller bearing supported on the eccentric ring, the roller bearing having an outer race formed as a perforating tool.

In accordance with an added feature of the invention, the actuating means include a roller bearing having an inner race formed as an eccentric ring.

In accordance with an additional feature of the invention, the eccentric ring is formed with a first stop and a second stop spaced from one another.

In accordance with yet another feature of the invention, the eccentric ring has an eccentricity with respect to the bearing and indexing shaft.

In accordance with yet a further feature of the invention, the holding device includes a stop provided on the carrier body.

In accordance with yet an added feature of the invention, the carrier body is formed with a stop, and the eccentric ring is formed with a pair of stops, and including a compression spring disposed between the stop of the carrier body and one of the pair of stops of the eccentric ring.

In accordance with yet an additional feature of the invention, the holding device includes a clamping screw disposed on the carrier body and tightenable for fixing the carrier body in position on the bearing and indexing shaft.

In accordance with still another feature of the invention, the eccentric ring is formed with a pair of stops, and also included are adjustment means provided on the carrier body and being operatively engageable with one of the pair of stops of the eccentric ring for radially adjusting the eccentric ring relative to the carrier body.

In accordance with still a further feature of the invention, the bearing and indexing shaft is formed with a continuous axial groove, and the carrier body is formed with a projection engaging in the continuous axial groove of the bearing and indexing shaft.

In accordance with a concomitant feature of the invention, the holding device includes a plurality of the carrier bodies mounted on the bearing and indexing shaft, the carrier bodies being selectively rotatable in a given direction relative to the bearing and indexing shaft into a position wherein the respective perforating tools are enabled, and in a direction opposite to the given direction for disabling the respective perforating tools.

One advantage attainable with the construction of the device according to the invention is that numbering mechanisms and perforating tools can now be brought into engagement independently of one another. The perforating tools are accommodatable on the bearing shaft thereof to arbitrary perforating formats. Accordingly, the free spaces between the numbering mechanisms can be utilized virtually optimally. Perforating and numbering impressions can now even be made at the same positions on the printing material. Because there is virtually no play between the eccentric ring and the carrier body, a highly accurate engagement of the positioning tools with the surface of a sheet-carrying cylinder and hence with the printing material can be achieved by means of the eccentric motion. By disposing the perforating wheels immediately opposite the sheet-carrying cylinder, it is possible to dispense with a lever bearing that would be elastically deformable.

In the further features of the concept upon which the invention is based, perforating rings are disposed on the eccentric ring on the roller bearing, which offers the advantageous advantage of reducing the play of the entire arrangement or assembly of the carrier body, the eccentric ring, the roller bearing and the perforating ring, to a minimum.

Besides the use of perforating rings, it is possible, in accordance with the invention, to provide the outer race of the roller bearing supported on the eccentric ring as a perforating tool.

Furthermore, the eccentric ring is provided both with a first stop and a second stop, and it is disposed with an eccentricity relative to the bearing shaft. As a result, the adjusting path can be kept very short. A stop is likewise provided on the carrier body. Also provided on the carrier body is a clamping screw with which the carrier body can be fixed in axial position on the bearing shaft. Matching or setting to the perforating positions can thus be carried out quite rapidly.

Between a stop of the eccentric ring and the stop of the carrier body, a compression spring is provided with which the carrier body and compression spring can be braced relative to one another, thereby eliminating play and enabling radial adjustment of the carrier body and eccentric ring relative to one another. Adjusting means, which are introduced into the carrier body and act upon the second stop of the eccentric ring permit the performance of a radial adjustment of the carrier body and the eccentric ring. Rotating the adjusting means results in a radial adjustment of the eccentric ring and carrier body relative to one another, opposite to the preloading of the compression spring.

Other features which are considered as characteristic for the invention are set forth in the appended claims.

Although the invention is illustrated and described herein as embodied in an arrangement for receiving indexable perforating tools, it is nevertheless not intended to be limited to the details shown, since various modifications and structural changes may be made therein without departing from the spirit of the invention and within the scope and range of equivalents of the claims.

Figure 2:
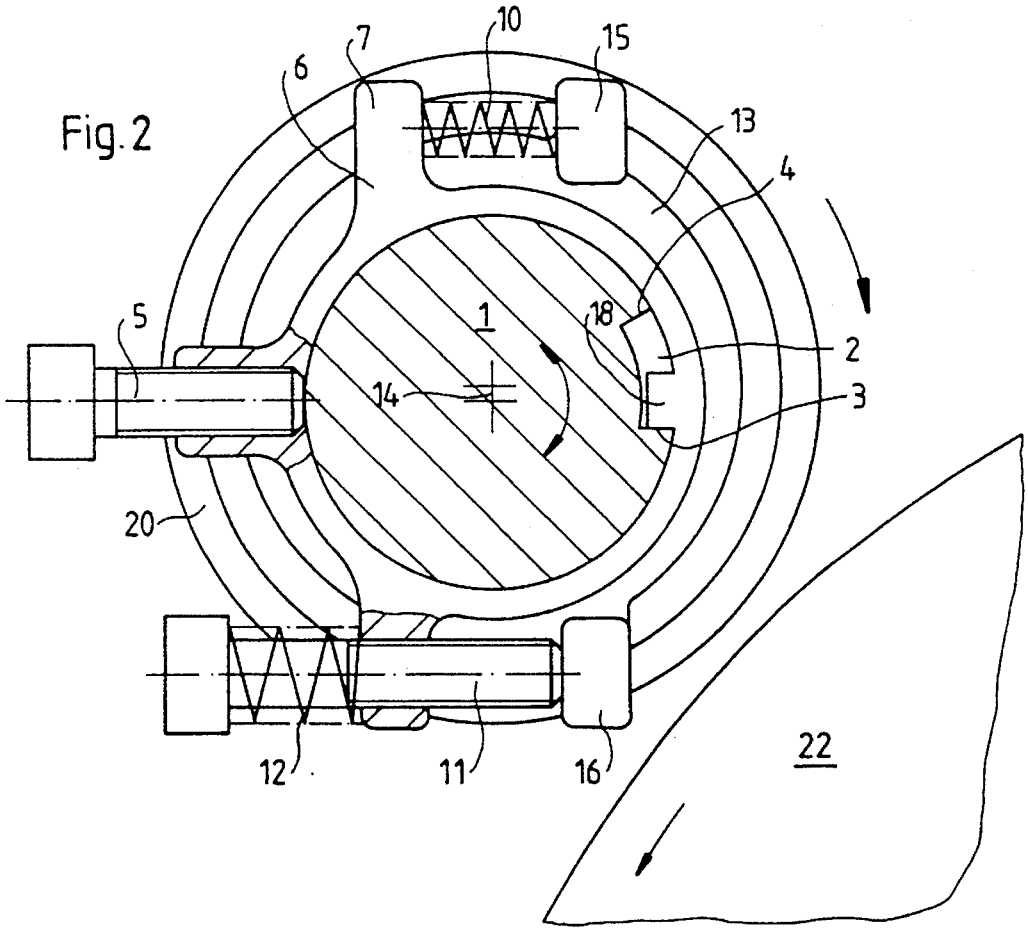
Figure 3:
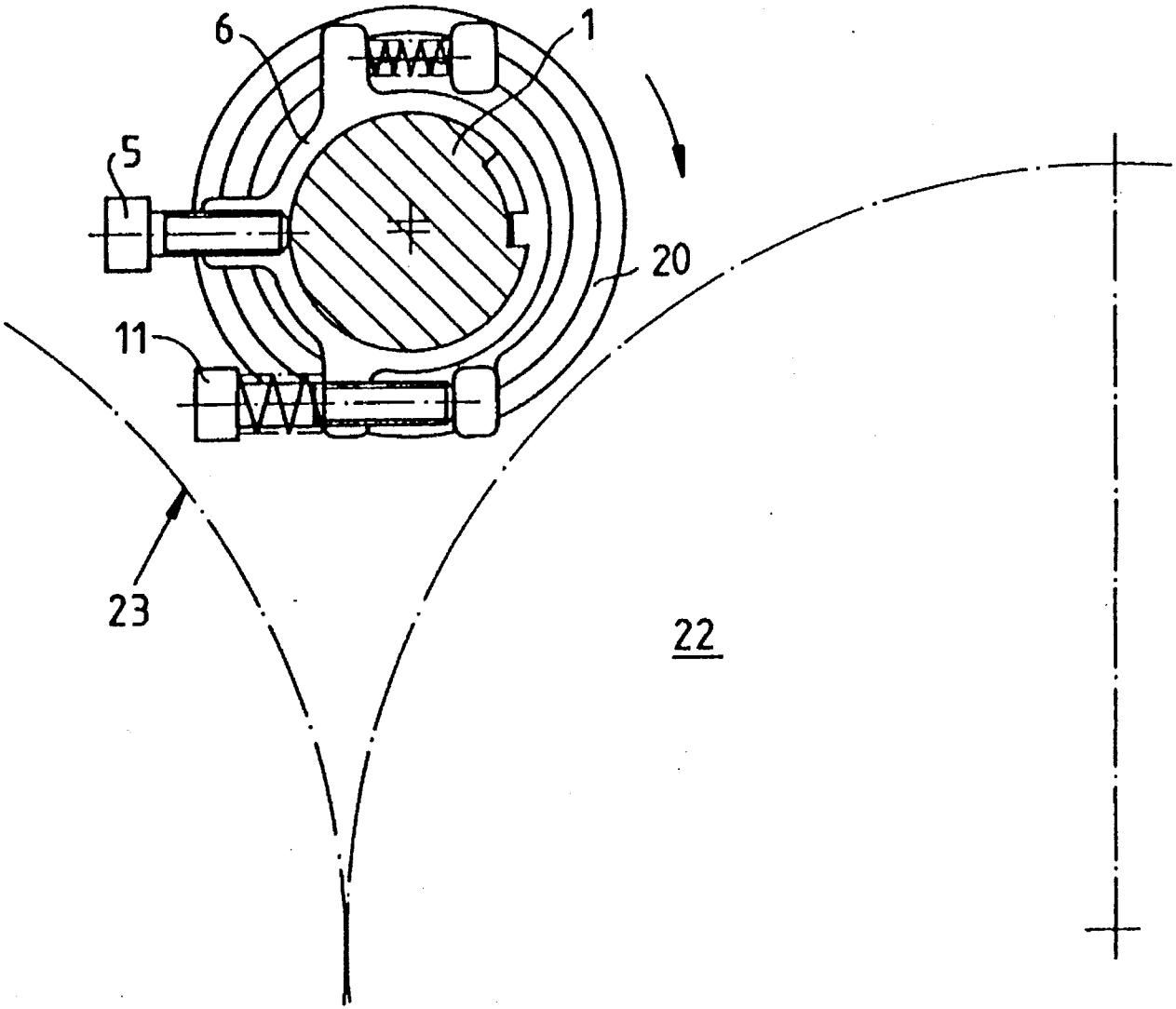

The construction and method of operation of the invention, however, together with additional objects and advantages thereof will be best understood from the following description of specific embodiments when read in connection with the accompanying drawings, in which:

FIG. 1 is a longitudinal sectional view of the arrangement for receiving indexable perforating tools according to the invention which includes a carrier body and an eccentric ring together with a roller bearing and a perforating crown or rim;

FIG. 2 is a view of FIG. 1, partly in cross section, as seen from the left-hand side of FIG. 1 and showing the arrangement disposed opposite a sheet-carrying cylinder; and FIG. 3 is view of FIG. 2 shown reduced in size and presenting a side view of the spatial arrangement of the perforating tool, together with a diagrammatically illustrated outer cylindrical surface of the sheet-carrying cylinder and an envelope curve of a numbering mechanism or unit.

Referring now to the drawing and, first, particularly to FIG. 1 thereof, there is shown therein, in a longitudinal sectional view, an arrangement for receiving indexable perforating tools in accordance with the invention.

A carrier body 6 is mounted on a bearing and indexing shaft 1, and is formed with a mounting bore 8 in an upper half of a stop 7 thereof and a threaded section 9 in a lower half of the stop 7, as viewed in the figure. An eccentric ring 13 supporting a roller bearing 19 is mounted on the carrier body 6. The roller bearing 19 and the eccentric ring 13 are fixed against axial displacement with respect to the carrier body 6 by a retaining ring 21 engaging a disk. On the roller bearing 19 is a perforating ring 20 which, in the middle thereof, has an annularly extending rib acting upon the material to be printed and producing the perforation in that material. The possibility also exists of forming the outer ring or race of the roller bearing 19 likewise as a perforating tool provided with a revolving rib, and there is also the possibility of forming the inner ring or race of the roller bearing 19 as an eccentric ring 13 as well. As is further suggested in FIG. 1, several of the carrier bodies 6 with the respective bearing and rings may be mounted on the shaft 1.

FIG. 2 is a cross-sectional view taken along a plane through the carrier body 6, the eccentric ring 13, the bearing and indexing shaft 1, as well as the roller bearing 19 and the perforating ring 20.

The bearing shaft 1 serving simultaneously as an indexing shaft, is formed with a continuous axial groove 2, which is defined radially by mutually spaced-apart stop faces 3 and 4. Formed on the inner wall of the carrier body 6 is a projection or protruberance 18 which engages in the axial groove 2. The carrier body 6 is fixable in position on the bearing and indexing shaft 1 by a clamping screw 5. Loosening the clamping screw 5 enables the carrier body 6 to be axially displaced into any arbitrary position on the bearing and indexing shaft 1, and thus enables the production of a perforation independently of numbering mechanism impressions. The eccentric ring 13, which has two stops 15 and 16, is located on the carrier body 6. With respect to the center of the bearing and indexing shaft 1, the eccentric ring 13 is disposed with an eccentricity 14 relative to the bearing and indexing shaft 1.

A compression spring 10 is received in the space between the stop 7 and the mounting or receiving bore 8 formed therein, on the one hand, and the first stop 15 of the eccentric ring 13, on the other hand, and braces the carrier body 6 and the eccentric body 13 against one another. Fine adjustments are possible by means of an adjusting device such as a setscrew 11, which is threadedly received by the threaded section 9 formed in the carrier body 6, and acts upon the second stop 16 of the eccentric ring 13. Thus, relative rotation of the eccentric ring 13, which supports the roller bearing 19 together with the perforating ring 20, with respect to the carrier body, which is fixed on the bearing and indexing shaft 1, is possible. The depth or thickness of the perforations can thus be adapted without difficulty to the material to be printed, which is guided on the circumference of the sheet-carrying cylinder 22, and is simple to adjust as needed during machine operation.

During operation, the perforating rings 20 are brought into engagement with the surface of the sheet-carrying cylinder 22 by rotating the bearing and indexing shaft 1 clockwise, in the direction represented by the lower half of the double-headed curved arrow shown in FIG. 2. The clamping screw 5 fixes the carrier body 6 in a predetermined axial position on the bearing and indexing shaft 1. During the rotation of the bearing and indexing shaft 1, the eccentricity 14 causes the perforating ring 20, mounted on the eccentric ring 13 through the intermediary of the roller bearing 19, to approach the surface of the sheet-carrying cylinder 22. By means of the adjusting means 11 prestressed by a spring 12, a fine adjustment of the perforation depth in the engaged condition is possible. This depth depends primarily on the printing material to be processed.

A rotary motion of the bearing and indexing shaft 1 in the opposite direction, i.e., the direction represented by the upper head of the double-headed curved arrow, causes the perforating tool to disengage from the surface of the sheet-carrying cylinder 22. In the situation shown in FIG. 2, the perforating tools 20 can be brought into engagement with the paper-carrying cylinder 22 by a clockwise indexing motion of the bearing and indexing shaft 1. A scale from which perforation depths can be read off can also be provided on the adjusting means 11 to assure easier replicability of respective settings once they have been effected.

If a plurality of perforating tools, whether outer rings of roller bearings or perforating rings, are mounted on the bearing and indexing shaft 1, then the possibility exists of disengaging or moving those perforating tools which are not needed for a printing job away from the material to be printed. To that end, the clamping screw 5 which clamps the carrier bodies 6 to the bearing and indexing shaft 1 is loosened. The carrier bodies 6 are then rotated counterclockwise on the bearing and indexing shaft 1, until the projection 18 rests on the stop face 4 of the axial groove 2. The clamping screw 5 is then tightened again. This procedure can be employed with any of the perforating tools which, in a given job, are not supposed to come into contact with the material to be printed when the bearing and indexing shaft 1 executes an indexing motion.

In contrast therewith, the perforating tools which act upon the printing material should be fixed on the bearing and indexing shaft 1 in such a way that the projection or protruberance 18 of the carrier body 6 engages the stop face 3 of the axial groove 2. Upon a clockwise indexing motion of the bearing and indexing shaft 1, the printing material is accordingly perforated by the perforating tools having carrier-body projections or protruberances 18 which engage with the stop face 3, while the perforating tools having carrier-body projections or protruberances 18 engaging the stop face 4 are moved back so far from the printing material that they do not come into contact with the printing material when the bearing and indexing shaft 1 executes an indexing motion towards the sheet-carrying cylinder 22.

After the clamping screw 5 has been tightened in the engaged position, that is, when the lower edge of the projection or protruberance 18 contacts the stop face 3 of the bearing and indexing shaft 1, a fine adjustment can be made between the carrier body 6 and the eccentric ring 13, if necessary, to adjust the perforation depth. Manual engagement and disengagement, limited by the radial extent of the axial groove in the bearing and indexing shaft 1, gives the pressman the capability of moving those perforating tools which are not needed at the moment away from the printing material located on the sheet-carrying cylinder 22, so that no perforations are made thereat. The perforating tools are engageable with the surface of the sheet-carrying cylinder 22 due to the indexing movements which are introducible into the bearing and indexing shaft 1 by couplings on the side walls.

This type of procedure may be necessary, for example, if numbering impressions are to be produced independently of perforations. The axial groove 2 enables the carrier bodies 6, which receive the perforating tools, to be brought into arbitrary axial positions between the numbering mechanisms. Due to the largely play-free construction of the device according to the invention, great stability of a once-achieved setting can be assured as well, making that setting invulnerable to any jarring which may occur during machine operation.

FIG. 3 shows the arrangement of the perforating tools between the sheet-carrying cylinder and the envelope curve of the numbering mechanism.

The bearing and indexing shaft 1, which carries the carrier body 6 together with the perforating tools 20, is disposed outside an envelope curve 23 described by the numbering mechanisms. It is thereby possible, in an extreme case, to adjust the positions of the carrier bodies 6 on the bearing and indexing shaft 1 by means of the clamping screw so as to enable perforations to be produced in the immediate vicinity of impressions made by the numbering mechanisms. The depth of the perforations in the printing material carried on the sheet-carrying cylinder 22 is adjustable by means of the adjusting device 11.

We claim:

1. A device for holding perforating tools opposite a sheet-carrying cylinder of a rotary printing press, comprising a bearing and indexing shaft, a carrier body axially displaceably supported by said shaft, said carrier body being formed with a bore extending therethrough axially parallel to said shaft, said carrier body being provided with clamping means for clamping said carrier body relative to said shaft and with actuating means for effecting a mutual clamping of said shaft and said carrier body and for releasing a mutual clamping of said shaft and said carrier body, said actuating means comprising rotatably supported rings carried by said carrier body around said shaft, said rings including an eccentric ring provided with a perforating tool, wherein said carrier body is formed with a stop, and said eccentric ring is formed with a pair of stops, and including a compression spring disposed between said stop of said carrier body and one of said pair of stops of said eccentric ring.

2. The holding device according to claim 1, wherein said actuating means include a roller bearing carrying a perforating ring supported on said eccentric ring.

3. The holding device according to claim 1, wherein said actuating means include a roller bearing supported on said eccentric ring, said roller bearing having an outer race formed as a perforating tool.

4. The holding device according to claim 1, wherein said actuating means include a roller bearing having an inner race formed as an eccentric ring.

5. The holding device according to claim 1, wherein said eccentric ring is formed with a first stop and a second stop spaced from one another.

6. The holding device according to claim 1, wherein said eccentric ring has an eccentricity with respect to said bearing and indexing shaft.

7. The holding device according to claim 1, including a stop provided on said carrier body.

8. A device for holding perforating tools opposite a sheet-carrying cylinder of a rotary printing press, comprising a bearing and indexing shaft, a carrier body axially displaceably supported by said shaft, said carrier body being formed with a bore extending therethrough axially parallel to said shaft, said carrier body being provided with clamping means for clamping said carrier body relative to said shaft and with actuating means for effecting a mutual clamping of said shaft and said carrier body and for releasing a mutual clamping of said shaft and said carrier body, said actuating means comprising rotatably supported rings carried by said carrier body around said shaft, said rings including an eccentric ring provided with a perforating tool, wherein said eccentric ring is formed with a pair of stops, and including adjustment means provided on said carrier body and being operatively engageable with one of said pair of stops of said eccentric ring for radially adjusting said eccentric ring relative to said carrier body.

* * * * *